US005645365A

United States Patent [19]

Malish et al.

[11] Patent Number: 5,645,365

[45] Date of Patent: Jul. 8, 1997

[54] COUPLING DEVICE FOR FLOOR MAINTENANCE MACHINES

[75] Inventors: Terrance J. Malish, Willoughby Hills; Kenneth L. Shary, Twinsburg; John D. Blazek, Willoughby, all of Ohio

[73] Assignee: The Malish Brush & Specialty Company, Willoughby, Ohio

[21] Appl. No.: 533,083

[22] Filed: Sep. 25, 1995

Related U.S. Application Data

[63] Continuation-in-part of Ser. No. 971,485, Nov. 4, 1992, abandoned, which is a continuation-in-part of Ser. No. 277,176, Jul. 19, 1994, abandoned.

[51] Int. Cl.[6] ..... B25G 3/00

[52] U.S. Cl. ..... 403/348; 403/345; 403/350; 403/353; 15/49.1

[58] Field of Search ..... 403/349, 348, 403/345, 350, DIG. 7, 11, 353, 351; 15/49.1, 50.1, 50.2, 50.3, 51, 52, 52.1, 52.2

[56] References Cited

U.S. PATENT DOCUMENTS

| | | |
|---|---|---|
| 362,767 | 5/1887 | McNair . |
| 2,110,135 | 3/1938 | Douglas . |
| 2,541,526 | 2/1951 | Lundquist . |
| 2,561,279 | 7/1951 | Holt . |
| 2,822,559 | 2/1958 | Manville . |
| 2,873,131 | 2/1959 | Metrailer . |
| 3,600,725 | 8/1971 | Feraki . |
| 4,114,225 | 9/1978 | Malish et al. . |
| 4,286,159 | 8/1981 | Kitta et al. . |
| 4,373,828 | 2/1983 | Sartori . |
| 4,391,548 | 7/1983 | Malish . |
| 4,756,638 | 7/1988 | Neyrat . |

OTHER PUBLICATIONS

Floor Machine Pad Holders & Rotary Brushes Catalog published by Rubbermaid Commercial Products, a division of EWU International Ltd., pp. 1–11, date unknown.

Floor Machine Brush Price List And Equipment Reference List of Malish Brush and Specialty Company, Catalog No. MB89A, pp. 1–47, date unknown.

*Primary Examiner*—Kenneth J. Dorner
*Assistant Examiner*—Bruce A. Lev
*Attorney, Agent, or Firm*—Watts, Hoffmann, Fisher & Heinke Co.

[57] ABSTRACT

A coupling device adapted for use with floor maintenance machines of the type used for floor brushing, buffing, polishing, scrubbing or the like and which facilitates the coupling of a maintenance element (i.e., brush, buffing disk or the like). The device comprises an annular plate member having a circular opening adapted to receive a circular drive hub carried by the machine drive shaft with the drive shaft having radially projecting lugs that are adapted to pass through radially extending arcuate recesses formed in the plate member so as to lockably engage behind the plate member. On one side of the coupling device, a first series of inner peripheral cam-like ramps communicate with one end of the arcuate recesses and on the opposite of the plate member, a second series of inner peripheral cam-like ramps communicate with the opposite ends of the arcuate recesses. The second series of ramps are carried by fingers that are capable of flexing and have centering portions that ensure an axially snug and stable fit between the coupling device and the circular drive hub carried by the machine drive shaft structure for centering the coupling device relative to the drive hub is provided. In an alternate embodiment, two sets of fingers are provided, one set of fingers being engageable when the drive hub is rotated in one direction, and the other set of fingers being engageable when the drive hub is rotated in an opposite direction.

34 Claims, 6 Drawing Sheets

COUPLING DEVICE FOR FLOOR MAINTENANCE MACHINES

CROSS REFERENCE TO RELATED APPLICATIONS

This is a continuation-in-part of U.S. application Ser. No. 07/971,485, filed Nov. 4, 1992, now abandoned, which is a continuation-in-part of U.S. patent application Ser. No. 08/277,176, filed Jul. 19, 1994, now abandoned.

TECHNICAL FIELD

The present invention relates to floor maintenance machines and more particularly relates to an improved coupling device for interconnecting a pad driving or brush assembly with a floor maintenance machine, such as used for buffing, cleaning, polishing and scrubbing.

BACKGROUND

Coupling devices, such as clutch plates for detachably mounting various maintenance elements (i.e., brush, pad holder) to floor maintenance machines are known. Many floor maintenance machines include a motor driven drive shaft and hub that is provided with radially extending lugs located near a terminal end. An annular clutch plate is secured to the maintenance element and includes structure engageable by the lugs on the drive hub. In particular, the clutch plate includes a central opening having radial recesses that enable the lugs to pass through the clutch plate when the drive hub is inserted into the clutch plate. After insertion, the clutch plate is rotated relative to the drive hub which causes the lugs to move axially behind the clutch plate to secure the maintenance element to the shaft. In at least one type of prior clutch plate, solid cast ramps (aluminum) were provided so that the lugs ride up the ramps until the lugs jam against the ends of ramps in the installed position to effect securement.

It has been recognized that such prior coupling arrangements are not completely satisfactory. For example, in these maintenance machines, the high-starting torque often times causes the clutch plate to become tightly wedged in place since the coupling is designed such that operating rotation of the machine drive hub tends to tighten the coupling. In other words, the coupling is designed to lock in the direction of operating rotation of the machine drive hub. Accordingly, with this wedging or binding affect, it becomes difficult to remove the maintenance element for any purpose. In addition, such wedging or binding, whether caused by the high-starting torques or by reason of the assembly or construction of the coupling itself, causes not only undue wear, but possible damage to the drive lugs and/or clutch plate that not only creates costly replacement problems, but also results in extended operator and machine downtime.

Furthermore, this wedging or binding action often times causes abrading of the lugs or ramps so that it is difficult to achieve a tight coupling between the component parts with the ultimate result that the maintenance element acts to oscillate off center or vibrate to the extent that good results cannot be achieved in the floor to be cleaned, polished, scrubbed or the like. In other words, such a condition results in an unsatisfactory floor finish. Still further, such prior coupling arrangements require the operator to lift or tilt the machine in order to enable the operator to manually engage the clutch plate member to the lugged shaft. This, of course, requires additional operator time that often times prompts the operator not to take the time to replace the maintenance element after it has become soiled or damaged, resulting in unsatisfactory performance. Further, such failure to remove the maintenance element can result in actual destruction to the element due to the machine weight, particularly after prolonged periods of time in storage.

A further problem with prior coupling devices relates to the "galvanic" action between the dissimilar metals (i.e., aluminum to steel) on the drive hub and the clutch plate. This combination results in corrosion between the parts and compounds the "galling" of the lugs or ramps that makes it extremely difficult to remove the brush or pad holder from the machine. This problem can become extremely severe in moist and/or wet conditions and where chemicals are introduced that act to accelerate the corrosion between the parts. Accordingly, when the clutch plate has to be broken away from the lugs, the opportunities to reuse the clutch plate without repair are minimized since the plate does not effectively accommodate (i.e., size and shape) itself to the drive lugs.

An improved coupling device for floor maintenance machines is described in U.S. Pat. No. 4,391,548, which alleviates at least some of the problems described above. The coupling device for floor maintenance machines described in this prior patent is arranged and constructed to enable automatic coupling and de-coupling of the maintenance element (i.e., brush, buffing pad holder or the like) without direct manual implementation thereof. This coupling device improves on the prior art and has performed satisfactorily.

It has been found, however, that the diameter of the maintenance machine drive hub can vary slightly from machine to machine. Because of this potential variance in diameter, the coupling between the machine drive hub and the pad holder assembly may not be centered. Additionally, the length of the drive hub can vary from machine to machine and accordingly, there can be axial "slop" between the coupling device and the lugs of the drive hub when the coupling device is mounted on the hub.

It is important that the buffing pad or cleaning brush be able to be quickly and easily installed and removed from the maintenance machine. The coupling device must securely mount the buffing disk or brush on the shaft consistently regardless of slight variance in drive hub dimensions from machine to machine.

SUMMARY OF THE INVENTION

The present invention provides an improved coupling device for floor maintenance machines. The coupling device is arranged and constructed to facilitate the coupling and de-coupling of the maintenance element (brush, buffing pad holder or the like) without the need for excessive force to effect installation or removal. In particular, the present invention represents an improvement to the coupling device disclosed in U.S. Pat. No. 4,391,548, which is hereby incorporated by reference, by having structure to radially center and account for axial slop between the coupling device and drive hubs that may vary in diameter or length from machine to machine.

The coupling device comprises an annular plate-like member having a central opening defined therein and a plurality of circumferentially spaced, arcuate recess portions adapted to receive drive lugs of the maintenance machine therethrough. The coupling device further includes a series of cam-like ramps communicating with the opposite ends of the recess portions and are located on the backside of the coupling device. This series of cam-like ramps each include multiple tapered surfaces located on axially resilient deflectable finger-like members. The resilient deflecting action in the axial direction accommodates variations in drive hub length.

In a more preferred embodiment, the coupling device also includes another series of inner peripheral cam-like ramps that communicate at one end with the recesses and are located on the top side of the coupling device. This other series of ramps serve to guide the drive lugs into the recesses during installation of the maintenance element onto the drive shaft.

Structure is also provided for centering the coupling device relative to the drive hub of the machine when the coupling device is connected. In the preferred embodiment, the centering structure comprises radially resilient deflectable finger-like members. In the preferred embodiment, the stabilizing structure comprises a centering portion on the finger-like member which tapers axially and projects radially from a radial surface of the finger-like member. The coupling device also includes structure for stabilizing the device relative to the drive shaft and ensuring a snug, stable radial fit between the device and drive hub when the device is connected to the drive hub. The stabilizing structure also includes clearances defined around the finger-like members which are capable of radially and axially flexing relative to the coupling device. The cam-like ramp portions, recesses and finger-like members are arranged and constructed for synergistic co-action between the component parts so as to facilitate the installation and removal of the maintenance element (i.e., brush, pad holder) from the machine drive hub without the need for excessive force to install or remove the element.

In alternate embodiments of the invention, the coupling device is integrally molded into a pad holder. Or, alternately, "insert molded" into a riser portion of a pad holder assembly.

In still another embodiment of the invention, two sets of stabilizing structures are provided so that relative rotation, in either direction, of the drive shaft with respect coupling device will effect coupling between the drive shaft and the coupling device.

Additional features of the invention will become apparent and a fuller understanding obtained by reading the following detailed description made in connection with the accompanying drawings.

BEST MODE FOR CARRYING OUT THE INVENTION

Figure 1:
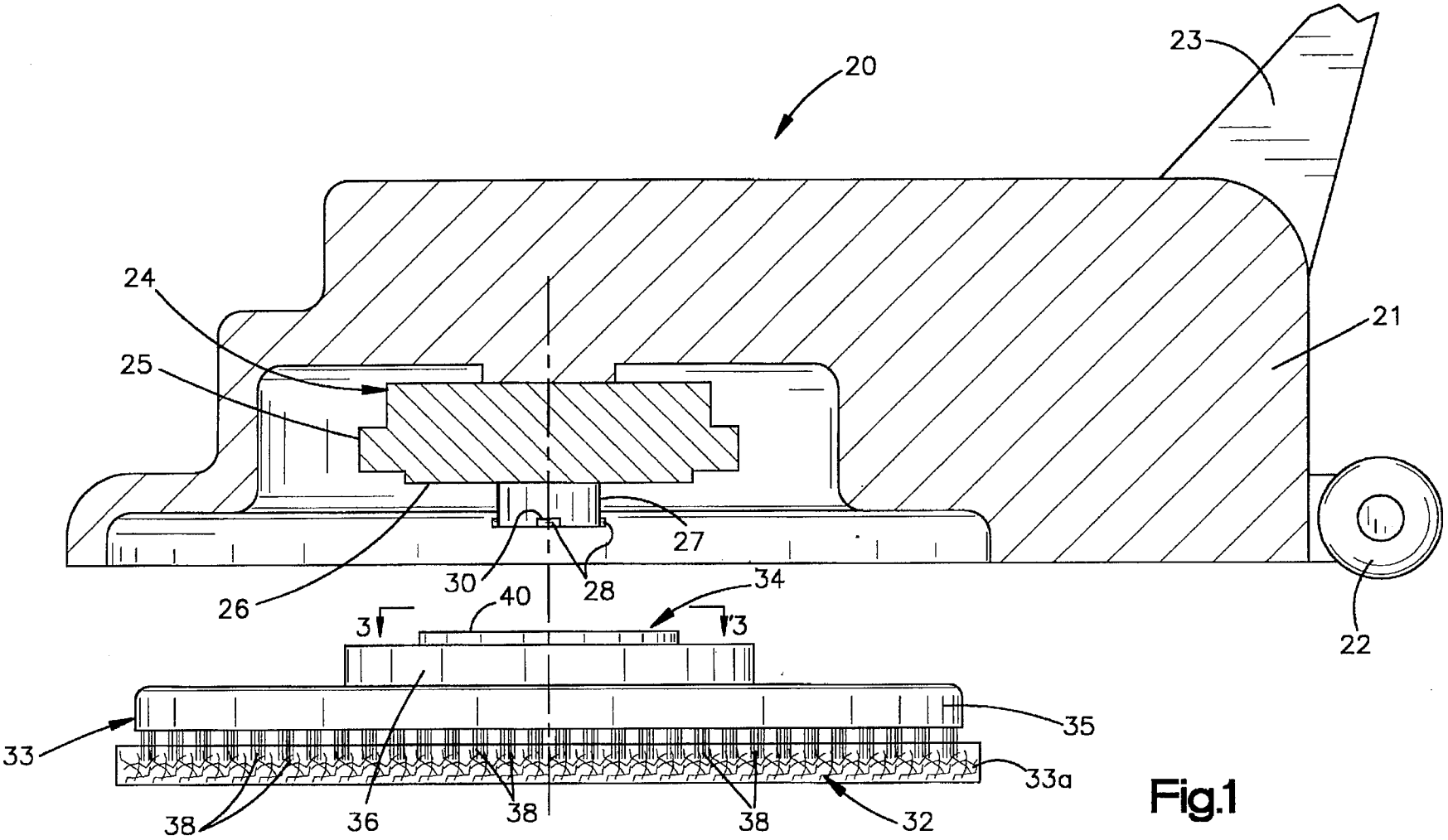
FIG. 1 is a side view of a floor maintenance machine and a pad assembly, portions of which are shown in section.

Referring to the drawings and particularly to FIG. 1, a conventional type floor maintenance machine 20 for use in various maintenance applications is illustrated. Typically, such types of floor maintenance machines may be utilized for various maintenance applications, such as buffing, cleaning, polishing, scrubbing or the like for commercial, institutional and/or industrial applications.

In general, the machine 20 includes a housing having a shroud 21 for movement via wheels 22 upon manipulation of a handle member 23. The machine 20 incorporates a drive member 24, as known in the prior art, having a horizontally disposed, planar under surface 26 from which depends an integral drive hub 27. The drive hub 27 includes a plurality (preferably three) of integral, radially extending drive lugs 28 that are symmetrically spaced around the periphery of the drive hub 27 and are axially spaced from the planar surface 26 of the drive member 24. The lugs 28 have a ledge or engagement surface 30, and may have rounded corners 25 (shown in FIG. 4).

The drive member 24, as is known, is driven by an electric motor (not shown) forming part of the machine 20. The drive member 24, in particular the drive hub 27, is coupled to a pad assembly 32 which rotates whenever the electric motor is energized. The pad assembly 32 includes a pad holder 33 to which a stripping, scrubbing or polishing pad **33*a*** is removably attached.

The pad assembly 32 is removably coupled to the drive hub 27 by a coupling device 34 constructed in accordance with a preferred embodiment of the invention. In particular, the drive lugs 28 forming part of the drive hub 27 operably engage structure, to be described, forming part of the coupling device 34.

The pad holder 33 is of the type described and claimed in U.S. Pat. No. 4,114,225. Generally, the pad holder 33 includes a circular support block member 35 that mounts a riser member 36. The support block member 35 and riser member 36 are formed from a suitable material, such as wood or plastic. The riser member 36 is provided with a circular opening (not shown) adapted to receive the coupling device 34 therein. The pad holder 33 incorporates a plurality of plastic bristles 38 for frictionally engaging an upper surface of the pad **33*a***, as is more fully described in U.S. Pat. No. 4,114,225.

Figure 2:
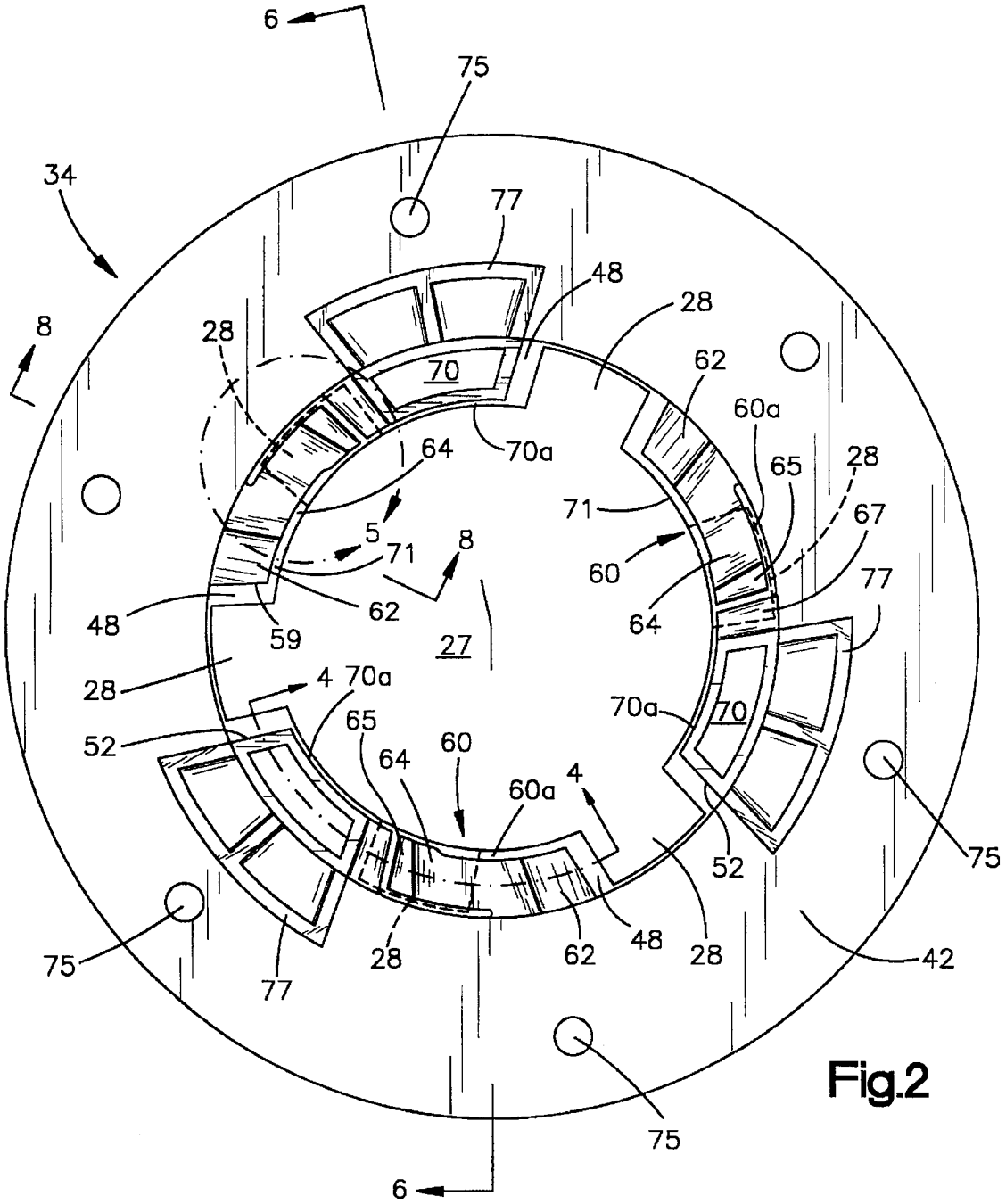
FIG. 2 is a bottom view of a coupling device embodying the present invention showing the positions of a drive hub of the floor maintenance machine during installation.
Figure 3:
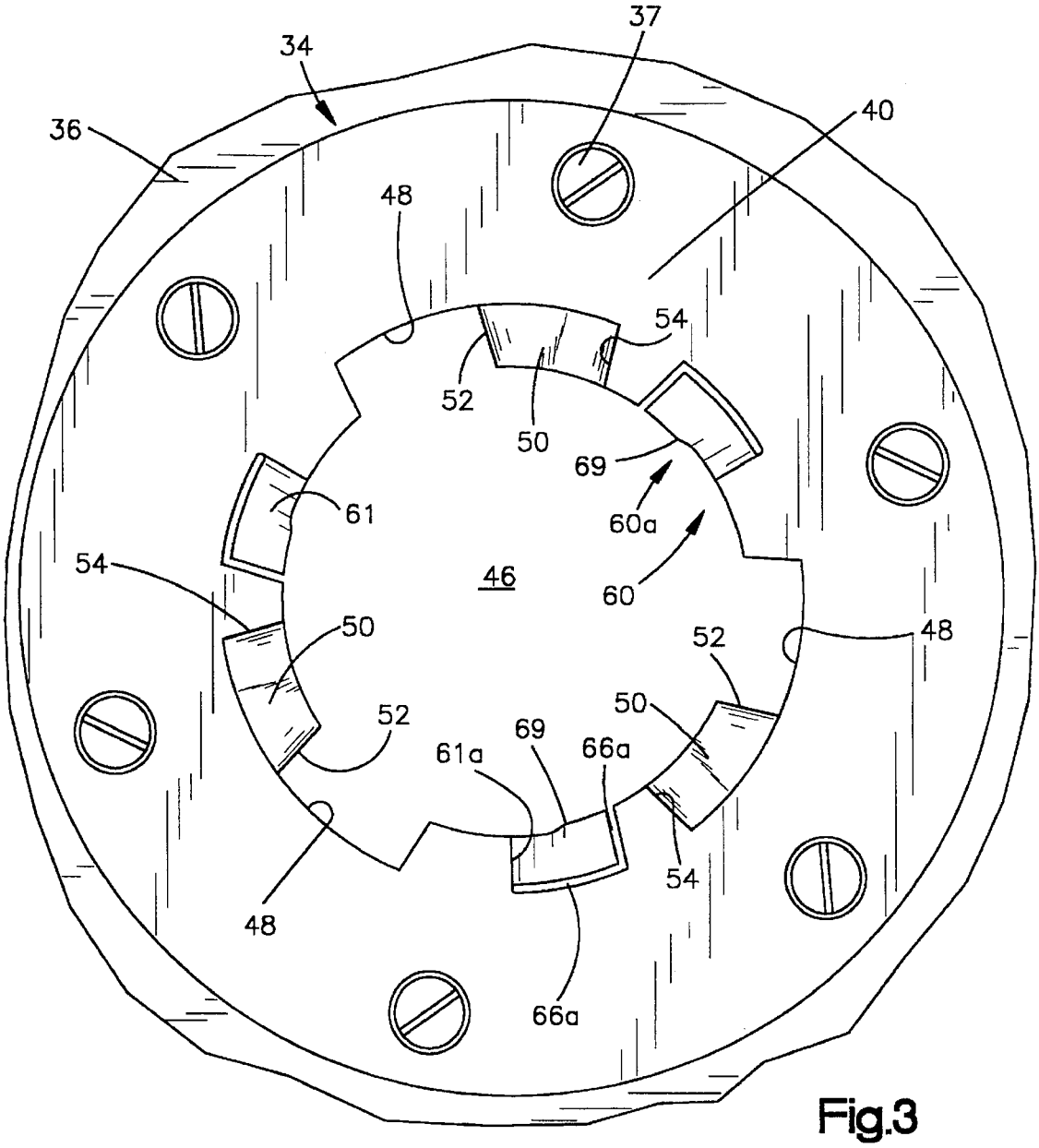
FIG. 3 is a fragmentary top view of the coupling device as viewed from the plane indicated by the line 3—3 in FIG. 1.

The coupling device 34 represents an improvement in the coupling device disclosed in U.S. Pat. No. 4,391,548 which is hereby incorporated by reference. The coupling device 34 provides structure by which the pad assembly 32 can be easily coupled and decoupled from the machine 20. Turning now to FIGS. 2 and 3, the construction of the coupling device 34 is illustrated. The coupling device 34 is a generally circular, plate-like device that is securely attached to the riser member 36 of the pad holder 33. As seen best in FIG. 3, the coupling device 34 is secured to the riser member 36 of the pad holder 33 by a plurality of threaded fasteners 37. The coupling device 34 includes an upper or top surface 40 (as viewed in FIG. 1 and shown in FIG. 3) and a planar lower surface or bottom side 42 (as viewed in FIG. 1 and shown in FIG. 2). Portions of the surface 42 confrontingly engage a top of the riser member 36.

Preferably, the coupling device 34 is molded from a high-strength polymeric material, such as thermoplastic, nylon resin. Example of this type of resin is commercially available under the registered trademark ZYTEL from DuPont.

Referring to FIGS. 2 and 3, the coupling device 34 includes a generally circular center opening 46 (shown only in FIG. 3) sized to closely receive the drive hub 27. The coupling device 34 has a plurality of circumferentially extending arcuate recesses 48 set radially outwardly from the opening 46 that are equal in number to the lugs 28 and are equally spaced about the inner periphery of the opening 46. Each of the recesses 48 are sized and located to allow a lug 28 to pass through a respective recess when the drive hub 27 is inserted into the opening 46.

On the top surface 40 and spaced intermediate the recesses 48, as illustrated in FIG. 3, there are located a first series of cam-like ramps 50 that correspond in number to the recesses 48. Looking in a counterclockwise direction in FIG. 3, the ramps 50 have generally helical surfaces that taper helically downwardly and inwardly so as to terminate, as at 52, at end wall defining the side wall of an associated recess 48. The ramp 50 is tapered slightly downwardly and inwardly in helical fashion toward the geometric center of the opening 46. The ramp portions 50 extend downwardly, as viewed in FIG. 3, from the line indicated by the reference 54, and have an inclined surface that extends downwardly and inwardly and below the general plane of the lower planar surface 42. During insertion of the drive hub 27, the ramps 50 tend to guide the lugs 28 into the recesses 48.

Figure 8:
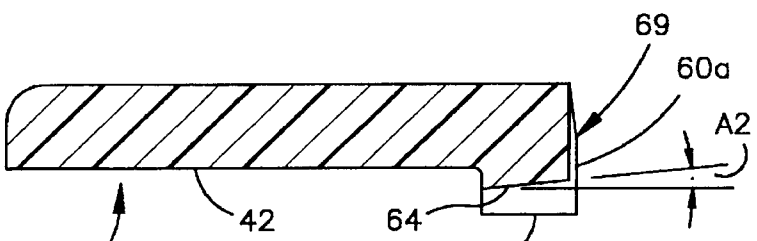
FIG. 8 is a cross-sectional view of another portion of the coupling device in FIG. 2, taken approximately along line 8—8 of FIG. 2.

As best illustrated in FIG. 2, a plurality of centering and axially stabilizing members 60 are positioned symmetrically about the inner periphery of the opening 48. In the preferred embodiment, three centering/stabilizing members 60 are provided and are generally arcuate, segmental sections. Each centering/stabilizing member 60 includes an axially deflectable and resilient finger-like portion 60*a*. The lower or bottom side of each member 60 (the same side as the side of the coupling device designated as 42) defines a second series of cam-like ramp surfaces 64, 65. The ramp surfaces 64, 65 defined on each member 60 each include multiple inclined surfaces that can best be described when considered in a clockwise direction. Accordingly, each ramp surface 64 on the member 60 includes a first inclined surface portion 62 (FIG. 4) that extends downwardly from an end wall 59 (shown in FIG. 4) to merge with a second inclined surface portion 63. The end wall 59 defines another side wall of the recess 48. The inclined surface portion 63 of ramp surface 64, in turn, merges into a flat surface 65 that extends substantially parallel to the lower side 42. As illustrated in FIG. 8, the ramp surface 64 is also inclined upwardly at a relatively small acute angle A2 from a radially outermost location, viewed to the left in FIG. 8, to its radially innermost location.

Figure 4:
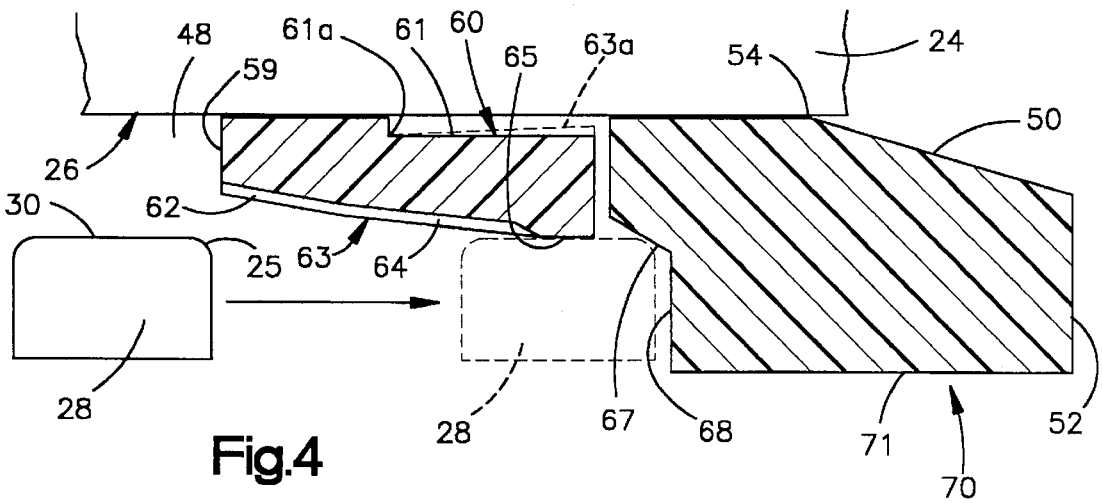
FIG. 4 Is an enlarged fragmentary sectional view taken along the line 4—4 of FIG. 2.

After installation, the ledge surface 30 defined on each drive lug 28 engages this flat surface 65 (see also FIG. 4). The ramp surfaces 64, 65 defined on the finger-like segments 60*a*, provide structure that axially stabilizes the device relative to the drive shaft 27 when the coupling device 34 is connected to the shaft. The axially resilient and deflectable finger-like portions 60a help ensure a snug and stable fit between the coupling device 34 and the lugs 28 of the drive hub 27 when the coupling device is connected to the drive hub.

Figure 5:
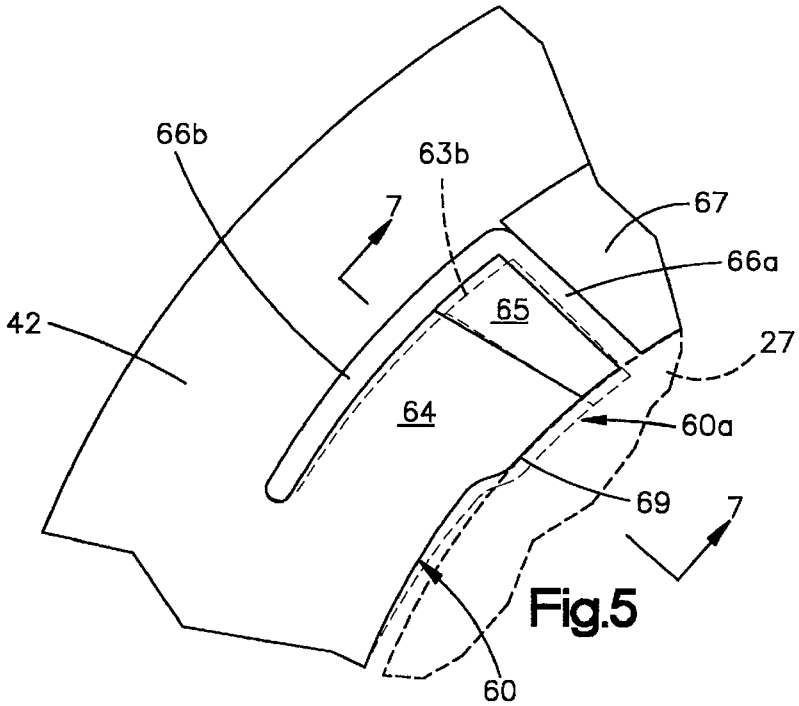
FIG. 5 is an enlarged fragmentary view of a portion of the coupling device approximately indicated by the circular line 5 in FIG. 2.
Figure 6:
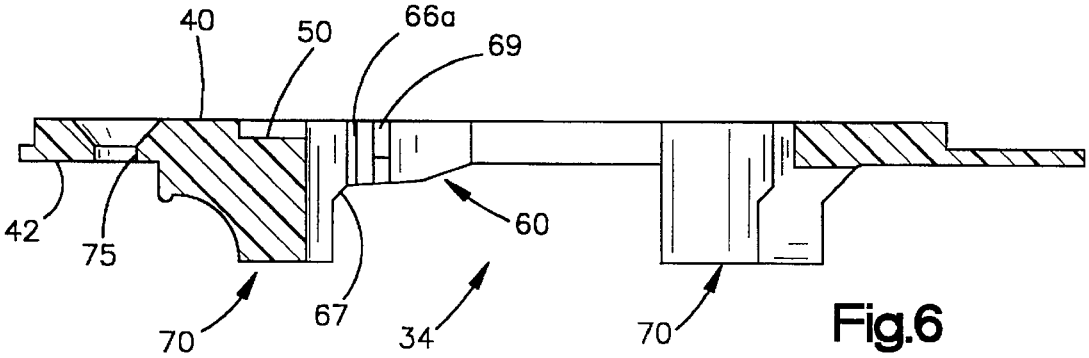
FIG. 6 is a sectional view as seen from the planes indicated by the line 6—6 in FIG. 2.

As best seen in FIGS. 4 and 5, the finger-like portions 60*a* (which define the ramp surfaces 64, 65) have clearances 66*a*, 66*b* defined around them such that the finger-like portions 60*a* are capable of axially flexing relative to the drive hub 27 and/or the lugs 28. By allowing each of the ramp defining finger-like portions 60*a* to flex axially relative to the coupling device 34 independently, the ramps further help stabilize the device 34 relative to the drive hub 38 when the device is connected to the drive hub. Referring specifically to FIG. 4, if one of the lugs 28 is located a greater axial distance upwardly along the drive hub 27 when compared to other lugs (or compared to lugs of a different maintenance machine), a ramp can independently accommodate this discrepancy in distance by having the ramp finger-like portion 60*a* (FIG. 3) resiliently flex upwardly (to the position shown in phantom, and indicated by the reference character 63*a*), and thereby maintaining a snug and stable fit of the coupling device 34 to the drive hub. To enable axial flexing of the finger-like portion 60*a*, a clearance or axial recess 61 is formed in each member 60. The clearance 66*b* (FIG. 5) is preferably co-existensive with the recess 61 (FIG. 4). In effect, each finger-like portion 60*a* can axially flex about a pivot 61*a* defined by a corner of the recess 61.

Figure 7:
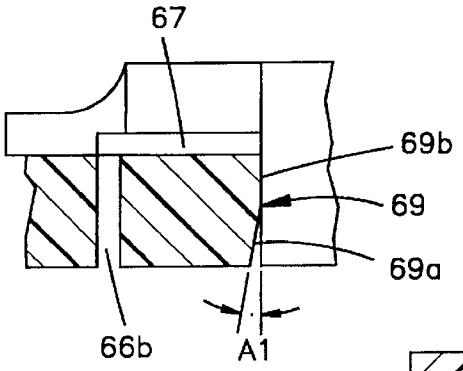
FIG. 7 is a cross-sectional view of a portion of the coupling device in FIG. 5, taken approximately along line 7—7 of FIG. 5.

Each centering/stabilizing member 60 also has a centering portion 69 (FIG. 5) that extends radially inward from the member towards the center of the circular opening 46. As viewed in FIG. 7, the centering portion 69 has a lower portion 69*a* that tapers slightly in an axial direction at an angle A1 from a radially larger diameter at its lowermost end to a radially smaller diameter at its upper end. The centering portion 69 also includes a cylindrical upper portion 69*b* with the larger diameter that is substantially parallel to and concentric with the surface defining the opening 46. The taper of the radially inward facing surfaces of the centering portion 69 minimizes the surface area contacting the drive hub 27 to minimize the frictional force holding the coupling device 34 and the drive hub together.

The centering portion 69 contacts the outer periphery of the circular drive hub 27 in order to provide a relative centering structure when the coupling device 34 is connected to the drive hub. Because each finger-like portion 60*a* can flex radially as well as axially, the centering portions 69 compensate for differences in the circumference of the circular hub 27 that sometimes occur among different machines 20. The radially flexed position of the finger-like portion 60*a* is shown in FIG. 5 prior to connection with the drive hub 27, and is designated by the reference character 63*b*.

An inclined surface 67 (FIG. 4) provides an abutment location for ultimate locking engagement with the associated lugs 28. This inclined surface 67 merges with a side wall 68 forming part of an abutment member 70. Side walls 59 and side walls 52 (FIG. 2) define the associated recesses 48 therebetween. The side walls 52, 68 may diverge slightly outward from one another toward the longitudinal central axis of the opening 46.

The end wall 52 and side wall 68 define the abutment member 70 that corresponds in number to the number of lugs 28 and recesses 48. The abutment members 70 project vertically away from the lower surface 42 of the coupling device 34, and are disposed generally axially below the associated ramps 50. The abutment members 70 have inner arcuate surfaces 70*a* that, together with the corresponding arcuate side surface 71 of the associated centering/stabilizing member 60, defines the inner periphery of the central opening 46. As seen in FIGS. 2 and 3, the first and second series of ramp portions are offset circumferentially from one another and with the side walls 68 (FIG. 4) of the abutment portions being generally offset with respect to the ramp initiation line 54. The coupling device 34 is provided with a plurality of apertures 75, adapted to receive the threaded fasteners 37, such as screws and the like, therethrough. By this arrangement, the coupling device can be fixedly attached to the riser block 36 so that the parts can be joined, as a unit, to the drive shaft member 24 for rotation therewith. The bottom surface 42 of the device 34 includes structure for centering the device in the riser block 36. Specifically, three arcuate wall segments 77 are provided and locate the coupling device 34 in the opening (not shown) in the riser block 36.

Figure 9:
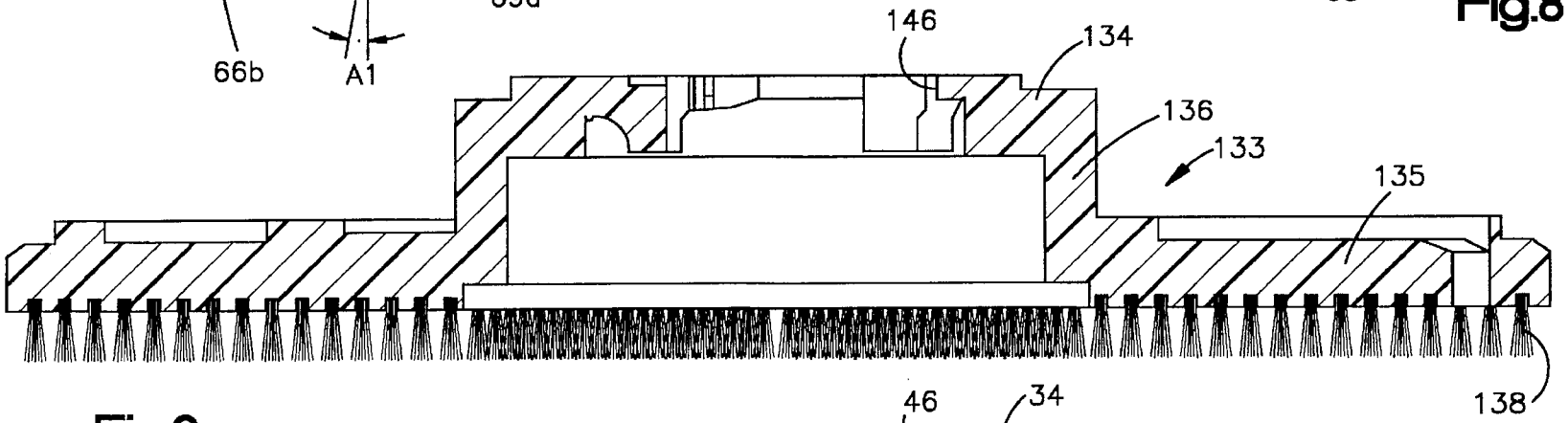
FIG. 9 is a cross-sectional view of an alternate embodiment of the coupling device integrally molded in a pad holder.

Alternate embodiments of the coupling device are illustrated in FIGS. 9–12. A pad holder 133 is illustrated in FIG. 9. The pad holder 133 is a one-piece integrally molded plastic assembly. The pad holder 133 includes a coupling device portion 134 that is integrally formed with a riser block portion 136. The coupling device portion 134 includes a central opening 146 into which the drive hub 27 may extend. The riser block 136 is integrally formed with a block member portion 135 which supports bristles 138. The coupling device portion 134 has all of the functional centering and stabilizing features of the coupling device 34, described above and illustrated in FIGS. 1–8, but has the further advantage of not requiring assembly with a riser block and block member.

Figure 10:
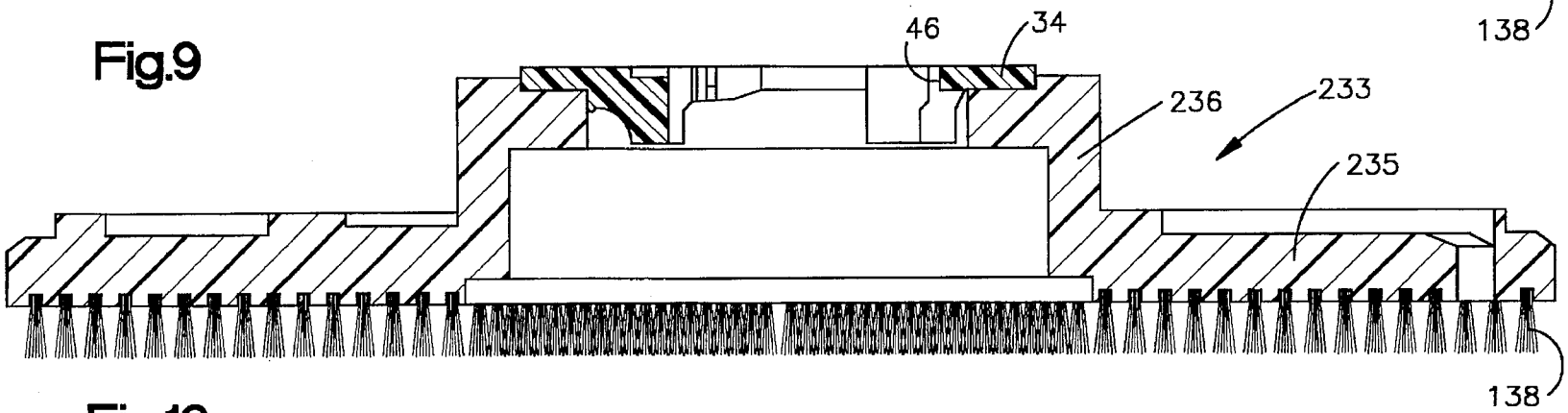
FIG. 10 is a cross-sectional view of another embodiment of the coupling device insert molded in a pad holder.

Another alternate embodiment of the present invention is illustrated in FIG. 10. A pad holder assembly 233 includes the coupling device 34 described above and illustrated in FIGS. 1–8. The coupling device 34 is "insert molded" into a riser block portion 236 that is integrally formed with a block member portion 235. A one-piece assembly results from a pre-made coupling device 34 being integrally formed with a riser block portion 236 and block member portion from a material that could conceivably have a different durometer characteristic than the coupling device, such as the material being softer or more resilient than the material of the coupling device. Thus, again, the pad holder assembly 233 has the advantage of not requiring the assembling together of plural parts, but uses already formed coupling devices.

Operation of the FIGS. 1–10 Embodiments

To connect the pad holder assembly 32 to the drive shaft 24 so that the assembly, including the pad 33, will be driven by the shaft 24 upon actuation of the motor drive unit by an operator, the pad holder assembly 32 that fixedly carries the attached coupling 34 is simply placed on the floor in the area to be treated. The machine 20 is tilted or "heeled" back, and then generally centered over the pad holder assembly 32 and clutch plate device 34. The operator may actuate the motor drive to rotate the drive shaft 24 in a counterclockwise direction, as viewed in FIG. 3. The drive hub is inserted into the opening 46 of the coupling device 34. During insertion, the drive lugs 28 are typically disposed in engaged relation on the upper surface 40 of the coupling device 34 such that, upon counterclockwise rotation of the drive shaft 24, the lugs 28 ride down the first incline ramps of 50 until the lugs 28 drop through the associated recesses 48. During this action, the lugs 28 pass through the recesses 48 and drop vertically downwardly in a generally parallel relationship with the confronting surfaces 52 and 59 defining the associated recesses 48. In this position, the ledge surface 30 of the lugs 28 are disposed below the general plane of the lower planar surface 42 of the coupling device 34. Continued rotation of the drive shaft 24 and hence, the lugs 28 (as shown in FIG. 4) in a counterclockwise direction, causes the ledge surfaces 30 of the associated lugs 28 to ride along the first inclined surfaces 62 of each centering/stabilizing member 60, thereby guiding the lugs 28 onto the second ramp surfaces 64. The lug surfaces 30 then engage the generally flat ramp surfaces 65. If necessary, the finger-like extensions **60*a* (FIG. 5) which define the surfaces 65 will bend downwardly to the position 63*a*, to accommodate the engagement by the ledge surfaces 30 of the lugs 28. This engagement will draw the coupling device 34 vertically upwardly into tight frictional engagement with the confronting surface 26 of the drive hub 27. Continued rotation of the drive shaft 24 drives the leading edges of the lugs 28 into engagement with the inclined abutment surfaces 67 defined on the abutment members 70. This provides a stop that ensures that the pad holder assembly 33 mounting the pad 32 rotates, as a unit, with the drive member 24 via the coupling device 34. Accordingly, it will be seen that the turning force or torque is relatively nominal as the lugs 28 ride up the first ramp surfaces 62 and then this force or torque progressively increases as the lugs 28 ride along the surfaces 64, and then finally into abutting engagement with the relatively steep inclined surfaces 67 so that the coupling device 34 is drawn into tight locking engagement with the drive hub 27 of the drive shaft 24** to complete the self-locking engagement between the component parts.

To remove the pad holder assembly 33, the machine may be tilted back until the pad 32 clears the floor surface and the drive shaft is again actuated by the operator then immediately stopped. This stopping action of the machine causes inertia forces in the pad holder assembly 33 that develops a reverse torque. This reverse torque pulls the lugs 28 away from the engagement with the inclined surfaces 67 and then across the generally planar surfaces 65 and down across the inclined surfaces 62 and through recesses 48 such that the coupling device 34, in effect, spins off the associated lugs 28 of the drive shaft 24 for automatic removal thereof. During this uncoupling, the operator need only give the switch one or two quick actuations of the drive motor.

In some applications, the coupling device 34 may not "spin off" the drive shaft using the above technique, due to the frictional engagement between the drive shaft 27 and the surfaces 67 and 69 defined on the centering/stabilizing members 60. Under these circumstances, the operator may need to manually spin-off the pad assembly 32. With the disclosed construction, however, a wedging/locking engagement between the coupling device and the drive shaft 27 is avoided (which would occur in at least some prior art coupling devices).

When the coupling device 34 is connected to the drive shaft 24, the surfaces 65 and centering portions 69 help ensure a snug and stable fit between the coupling device 34 and the drive shaft 24. Because the ramp surfaces are defined on the fingers **60*a* which are capable of flexing, the surfaces 65 and centering portions 69 also help compensate for variations in the general shape of the drive shaft 24**.

The embodiments shown in FIGS. 1–10 are given to illustrate one example of the invention intended for use with a floor machine having a predetermined direction of rotation. It should also be apparent that various other structural arrangements could be utilized in accordance with the principles of the present invention. As an example, the lug 28 arrangement of the drive shaft 24 could be modified with any size and/or shape of lugs in any arrangement and/or number of such lugs in accordance with the principles of the invention. It will be seen that the coupling device 34 of the invention can be used with any type of brush or pad holder and hence, may be utilized with a brush or pad holder that does not incorporate a riser block member 36, but wherein the coupling device is connected directly to the block member 35. It will also be seen that while one relative rotational direction for attaching the coupling devices 34, 134 to the drive hub 27 has been described and illustrated, the coupling devices could be modified to permit opposite attaching relative rotation.

Figure 11:
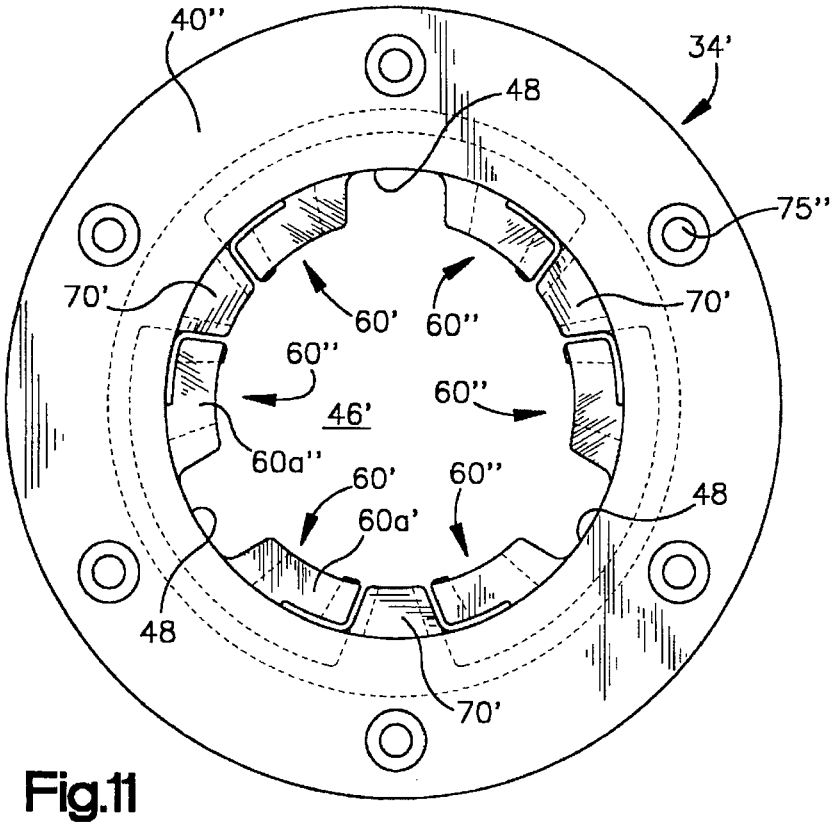
FIGS. 11 and 12 illustrate bottom and top views of another embodiment of the invention.
Figure 12:
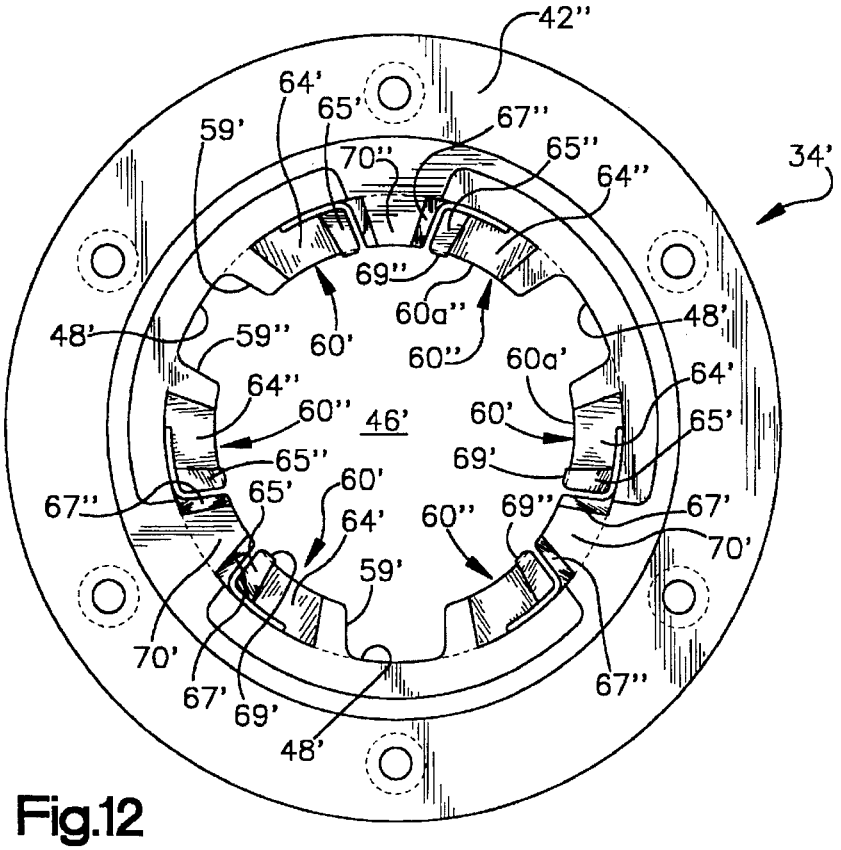

The embodiment of FIGS. 11 and 12

FIGS. 11 and 12 illustrate another embodiment of the invention in which relative rotation in either direction will effect coupling of a coupling device 34' with the drive shaft 24. To facilitate the explanation, elements of the coupling device 34', which have the same or similar functions to corresponding elements in the embodiment of FIGS. 1–8 will be given like reference characters followed by an apostrophe.

The coupling device 34' is substantially similar in construction to the configuration of the coupling device 34 (shown in FIGS. 1–8), except that it includes two sets of stabilizing members indicated by the reference characters 60', 60". The coupling device 34' includes top and bottom surfaces 40", 42" and three circumferentially extending arcuate recesses 48', set radially outwardly from a central opening 46' and, as in the case of the FIG. 1 embodiment, are equal in number to lugs 28 that form part of a drive shaft (shown in FIG. 2). The coupling device 34' is provided with a plurality of apertures 75" which are similar, if not identical, to the apertures 75 forming part of the embodiment shown in FIGS. 1–8. The stabilizing members 60', 60" are substantially similar, if not identical, in configuration to the stabilizing members 60 forming part of the FIG. 1 embodiment. The stabilizing members are positioned symmetrically about the inner periphery of the central opening and are generally arcuate in extension. Each centering/stabilizing member 60', 60" includes an associated, axially deflectable and resilient finger-like portion **60*a*', 60*a*"**, respectively.

The coupling device 34' includes three equally spaced abutment members 70'. As can be seen from the drawings, the abutment member 70' are smaller in size than the abutment members 70 of the FIG. 1 embodiment. The abutment members 70' are positioned between each pair of stabilizing members 60', 60". The abutment members 70' include inclined abutment surfaces 67', 67" associated with adjacent center/stabilizing members 60', 60". The incline abutment surfaces 67', 67" serve the same function as the abutment surfaces 67 described in connection with the FIG. 1 embodiment and shown in FIG. 2.

Each center/stabilizing member 60' preferably includes a series of cam-like ramp surfaces 64', 65', and the members 60" include ramp surfaces 64", 65". Preferably, the ramp surfaces 64', 64", 65', 65" are substantially similar in configuration to the ramp surfaces 64, 65 described in connection with the coupling device of FIGS. 1–8. Each member 60', 60", preferably includes an end wall 59', 59" and a centering portion 69', 69".

The members 60', 60" perform the same centering and stabilizing function that the members 60 provide. In operation, drive lugs 28 of a drive shaft 24 are inserted into the central opening 46' and are allowed to pass through the recesses 48'. Once the lugs are disposed below the general plane of the lower planar surface 42' of the coupling device 34, the drive shaft 24 may be rotated in either direction in order to engage and lock the coupling device 34' to the drive shaft. The direction of rotation of the drive shaft determines which set of stabilizing members 60', 60" will be engaged. Specifically, as viewed in FIG. 12, if the drive shaft is rotated clockwise, the stabilizing members 60' will be engaged, whereas if the drive shaft is rotated counterclockwise, the stabilizing member 60" will be engaged.

The embodiment shown in FIGS. 11 and 12 expands the utility of the present invention. With the disclosed coupling device 34', a specific rotational orientation does not have to be specified in order to use the device. The device 34' is equally engageable by rotation in either direction of the drive shaft 28.

Although the invention has been described with a certain degree of particularity, it should be understood that those skilled in the art can make various changes to it without departing from the spirit or scope as hereinafter claimed.

We claim:

1. A coupling device for use with a floor maintenance machine of the type that detachably mounts a rotatable brush or pad holder member for carrying a cleaning element, such machine including a drive hub having a plurality of integral, drive lugs projecting radially therefrom, said coupling device comprising:

a) a plate member having a front side and a back side;

b) a generally circular opening defined within said plate member, said opening including a plurality of circumferentially spaced, arcuate and radially extending recess portions adapted to receive the drive lugs therethrough;

c) a first series of inner peripheral cam-like ramps that communicate at one end with said recess portions and are located on said front side of said plate member;

d) a second series of inner peripheral cam-like ramps communicating with opposite ends of said recess portions and are located on said back side of said plate member, said second series of cam ramps each including multiple tapered surfaces;

e) centering structure for centering said device relative to said drive hub when said device is connected; and f) axial stabilizing structure for stabilizing said device relative to said drive hub and ensuring a snug, stable fit between said device and drive hub when said device is connected to said drive hub whereby relative axial movement between said device and said drive hub is inhibited.

2. The coupling device of claim 1 wherein said centering structure comprises a plurality of radially resilient fingers each having a centering portion located on a radially facing surface for engaging the drive hub.

3. The coupling device of claim 2 wherein each centering portion has an axially extending tapered surface portion.

4. The coupling device of claim 1 wherein said stabilizing structure comprises a raised portion located on each ramp of said second series of ramps, each raised portion being located at a highest of said tapered surfaces.

5. The coupling device of claim 1 wherein said stabilizing structure includes recesses defined around said second series of ramps such that said ramps are defined on axially resilient fingers capable of axial flexing relative to said coupling device.

6. The coupling device of claim 5 wherein said second series of ramps includes a portion that extends radially inward at an angle from said back side towards said front side.

7. A coupling device for use with a floor maintenance machine of the type that detachably mounts an implement holder member, the maintenance machine including a rotatable drive hub having a plurality of integral drive lugs projecting radially therefrom, said coupling device comprising:

a) a unitary circular plate member having a first side for abuttably engaging a surface forming part of said maintenance machine and an opposite second side including structure engageable by said drive lugs to operatively interconnect said coupling device with said drive hub;

b) a central, generally circular opening defined by said plate member, said plate member further defining a plurality of symmetrically spaced recesses which extend radially from said generally circular opening, said recesses sized and located to receive said drive lugs therethrough;

c) said plate member further defining a plurality of centering members and a plurality of associated abutment members positioned around an inner periphery of said central opening, said centering/stabilizing members and said abutment members defining, at least in part, said recesses;

d) said abutment members each defining a ramp surface for guiding said drive lugs into said recesses during installation of said implement holder member;

e) each of said centering/stabilizing members being generally arcuate in shape and comprising an extension, each extension being adapted to flex in either a radial or axial direction, or both in order to accommodate variations in diameter of said drive hub and axial positions of said drive lugs, respectively;

f) said extensions each defining at least one surface engageable by said drive lugs by which said coupling device is held to said drive hub;

g) said extensions each including a radially projecting centering portion engageable with a periphery of said drive hub whereby said coupling device is centered with respect to a rotational axis of said drive hub.

8. The apparatus of claim 7 wherein each of said centering/stabilizing members defines multiple tapered surfaces engageable with an engagement surface defined on said drive lugs during installation.

9. The apparatus of claim 8 wherein at least a portion of said multiple tapered surfaces extends radially inward at an angle from said second side to said first side.

10. The apparatus of claim 8 wherein said multiple tapered surfaces include a first inclined surface that merges with a second inclined surface which, in turn, merges with a relatively flat, planar surface.

11. The apparatus of claim 10 wherein said abutment members define an inclined abutment surface engageable by said drive lugs, said abutment surface providing a stop for said drive lugs and also providing a surface through which drive forces from said drive hub are transmitted to said coupling device.

12. The apparatus of claim 11 wherein said inclined abutment surface is spaced from said flat planar surface defined by said extensions.

13. The apparatus of claim 7 wherein radially projecting centering portion includes a tapered surface that axially extends radially inward from said first side toward said second side.

14. The apparatus of claim 7 wherein said plate member defines three recesses, three centering members and three abutment members.

15. The apparatus of claim 14 wherein said recesses are generally arcuate in shape.

16. The apparatus of claim 7 wherein said coupling device is molded from a thermo plastic, polyester resin.

17. The coupling device of claim 7, further comprising two sets of said plurality of centering members, one set of which is engaged by said drive lugs when said rotatable drive hub is rotated in one direction, the other set of which is engaged by said drive lugs when said drive hub is rotated in an opposite direction.

18. A coupling device for releasably coupling a polishing or cleaning element to a rotatable drive member forming part of a floor maintenance machine, said coupling device comprising:

a) mounting structure for enabling said coupling device to be secured to said polishing or cleaning element;

b) a central, generally circular opening defined by said device, said device further defining a plurality of spaced recesses which extend radially from said generally circular opening, said recesses sized and located so as to receive engagement structure forming part of said rotatable drive member therethrough;

c) said device further defining a plurality of centering members, at least one of said centering members comprising a finger adapted to flex in either the axial or radial direction or both; and d) said finger defining at least a first surface engageable by said engagement structure forming part of said rotatable drive member by which said coupling device is held to said drive member and a second surface arranged to engage a periphery of said rotatable drive member whereby said coupling device is centered with respect to a rotational axis of said drive member.

19. The coupling device of claim 18 wherein each of said centering members comprises a finger adapted to flex in either the axial or radial direction or both.

20. The coupling device of claim 19 wherein each of said centering members defines multiple tapered surfaces engageable with said engagement structure forming part of said rotatable drive member.

21. The coupling device of claim 18 wherein said first surface comprises a generally planar surface extending obliquely with respect to a rotational axis of said rotatable drive member.

22. The coupling device of claim 18 wherein said first surface of said finger is engageable by one of a plurality of radial extending lugs forming part of said engagement structure.

23. The coupling device of claim 22 wherein said second surface comprises a side surface extending laterally from said finger and arranged to abuttably contact a circumferential surface of said drive shaft.

24. The coupling device of claim 18 further including a pad holder integrally molded as one piece with said coupling device.

25. The coupling device of claim 18 further including a pad holder insert molded to said coupling device.

26. The coupling device of claim 18, wherein said device includes two sets of said plurality of centering members wherein one set of said members is engaged by said drive member when said drive member is rotated in one direction, and said other set of centering members is engaged when said drive member is rotated in an opposite direction.

27. A coupling device for use with a floor maintenance machine of the type that detachably mounts an implement holder member, the maintenance machine including a drive shaft having a plurality of integral, drive lugs projecting radially therefrom, said coupling device comprising:

a) a unitary circular plate member having one side for abuttably engaging a drive element forming part of said maintenance machine and an opposite side including structure engageable by said drive lugs to operatively interconnect said coupling device with said drive shaft;

b) a central, generally circular opening defined by said plate member, said plate member further defining a plurality of symmetrically spaced recesses which extend radially from said generally circular opening, said recesses sized and located to receive said drive lugs therethrough;

c) said plate member further defining a plurality of centering members and a plurality of associated abutment members positioned around an inner periphery of said central opening, said centering members and said abutment members defining, at least in part, said recesses;

d) each of said centering members defining multiple tapered surfaces engageable with an engagement surface defined on said drive lugs during installation, said multiple tapered surfaces each including a first inclined surface that merges with a second inclined surface which, in turn, merges with a relatively flat, planar surface;

e) said abutment members each defining a ramp surface for guiding said drive lugs into said recesses during installation of said implement holder member;

f) each of said centering members being generally arcuate in shape and including an extension, said extension being adapted to flex in either a radial or axial direction, or both in order to accommodate variations in diameter of said drive shaft and axial positions of said drive lugs, respectively;

g) said extensions each defining at least one surface engageable by said drive lugs by which said coupling device is held to said drive shaft;

h) said extensions each including a radially extending portion engageable with a periphery of said drive shaft whereby said coupling device is centered with respect to a rotational axis of said drive shaft.

28. A coupling device for releasably coupling a polishing or cleaning element to a rotatable drive member, forming part of a floor maintenance machine, said coupling device comprising:

a) a central opening defined by said device and a plurality of spaced recesses which extend radially from said opening, said recesses sized and located so as to receive engagement structure forming part of said rotatable drive member therethrough;

b) said device further defining two sets of centering members, at least one of said centering members of each set comprising a finger adapted to flex in either the axial or radial direction or both in order to accommodate dimensional variations in said engagement structure; and c) the finger of one set having an alternate end and a free end and defining at least one surface engageable by said engagement structure forming part of said rotatable drive member when said rotatable drive member is rotated in a first direction, and the said finger of the other set having an alternate end and a free end and defining at least one surface engageable by said engagement structure of said rotatable drive member when said drive member is rotated in another direction, whereby said coupling device is held to said drive member, the fingers being arranged such that a finger of the one set is disposed in an opposing relationship with respect to a corresponding finger of the other set.

29. The coupling device of claim 28, wherein each of said centering members defines multiple tapered surfaces engageable with said engagement structure forming part of said rotatable drive member.

30. The apparatus of claim 29, wherein each of said fingers includes a second surface arranged to engage a periphery of said rotatable member whereby said coupling device is centered with respect to a rotational axis of said drive member.

31. The coupling device of claim 30, wherein said first surface of said finger is engageable by one of a plurality of radial extending lugs forming part of said engagement structure.

32. The apparatus of claim 31, wherein each of said centering members includes a finger adapted to flex in either the axial or radial direction, or both.

33. A coupling device for releasably coupling a polishing or cleaning element to a rotatable drive member, forming part of a floor maintenance machine, said rotatable drive member including a drive hub having a plurality of integral, drive lugs projecting radially therefrom, said coupling device comprising:

a) a central opening defined by said device and a plurality of spaced recess which extend radially from said opening, said recesses sized and located so as to receive said drive lugs forming part of said rotatable drive hub therethrough;

b) said device further defining two sets of centering members, at least one of said centering members of each set comprising a finger adapted to flex in either a radial or axial direction or both in order to accommodate variations in a diameter of said drive hub and axial positions of said drive lugs, respectively; and, c) the finger of one set having an alternate end and a free end and defining at least one surface engageable by one of said drive lugs when said rotatable drive member is rotated in a first direction, and the said finger of the other set having an alternate end and a free end and defining at least one surface engageable by one of said drive lugs when said drive member is rotated in another direction, whereby said coupling device is held to said drive member, the fingers being arranged such that a finger of the one set is disposed in an opposing relationship with respect to a corresponding finger of the other set.

34. A coupling device for releasably coupling a polishing or cleaning element to a rotatable drive member, forming part of a floor maintenance machine, said rotatable drive member including a drive hub having a plurality of integral, drive lugs projecting radially therefrom, said coupling device comprising:

a) a central opening defined by said device and a plurality of spaced recess which extend radially from said opening, said recesses sized and located so as to receive said drive lugs forming part of said rotatable drive hub therethrough;

b) said device further defining two sets of centering members, at least one of said centering members of each set comprising a finger adapted to flex in a radial direction in order to accommodate variations in diameter of said drive hub; and, c) the finger of one set having an alternate end and a free end and defining at least one surface engageable by one of said drive lugs when said rotatable drive member is rotated in a first direction, and the said finger of the other set having an alternate end and a free end and defining at least one surface engageable by one of said drive lugs when said drive member is rotated in another direction, whereby said coupling device is held to said drive member, the fingers being arranged such that a finger of the one set is disposed in an opposing relationship with respect to a corresponding finger of the other set.

* * * * *